US007007617B2

(12) United States Patent
Johnston

(10) Patent No.: US 7,007,617 B2
(45) Date of Patent: Mar. 7, 2006

(54) GATE ASSEMBLY FOR TUFTING MACHINE

(75) Inventor: Kendall Johnston, Dalton, GA (US)

(73) Assignee: Card-Monroe Corp., Chattanooga, TN (US)

( * ) Notice: Subject to any disclaimer, the term of this patent is extended or adjusted under 35 U.S.C. 154(b) by 0 days.

(21) Appl. No.: 10/990,734

(22) Filed: Nov. 17, 2004

(65) Prior Publication Data

US 2005/0109253 A1 May 26, 2005

Related U.S. Application Data

(60) Provisional application No. 60/525,761, filed on Nov. 26, 2003.

(51) Int. Cl.
*D05C 15/22* (2006.01)

(52) U.S. Cl. ..... 112/80.51

(58) Field of Classification Search ..... 112/80.5–80.6, 112/475.08

See application file for complete search history.

(56) References Cited

U.S. PATENT DOCUMENTS

| | | | | |
|---|---|---|---|---|
| 2,213,552 A | | 9/1940 | Scharr | |
| 2,879,728 A | | 3/1959 | McCutchen | |
| 3,103,903 A | | 9/1963 | Broadrick et al. | |
| 3,375,797 A | | 4/1968 | Gaines | |
| 3,489,326 A | | 1/1970 | Singleton | |
| 3,709,173 A | | 1/1973 | Greene | |
| 3,835,797 A | | 9/1974 | Franks et al. | |
| 3,847,098 A | | 11/1974 | Hammel, Jr. | |
| 3,926,132 A | | 12/1975 | Lear et al. | |
| 3,976,298 A | * | 8/1976 | Hinchman | 473/585 |
| 4,111,646 A | | 9/1978 | Buckwalter et al. | |
| 4,134,347 A | | 1/1979 | Jolley et al. | |
| 4,134,348 A | | 1/1979 | Scott | |
| 4,185,569 A | | 1/1980 | Inman | |
| 4,382,704 A | | 5/1983 | Hendrschk | |
| 4,466,366 A | * | 8/1984 | Hirotsu | 112/80.56 |
| 4,532,667 A | | 8/1985 | Komesker et al. | |
| 4,608,935 A | | 9/1986 | Bardsley | |
| 4,660,460 A | * | 4/1987 | Fulmer | 91/376 R |
| 4,822,241 A | | 4/1989 | Jarvis et al. | |
| 4,856,441 A | | 8/1989 | Kurata | |
| 4,864,946 A | | 9/1989 | Watkins | |
| 5,094,178 A | | 3/1992 | Watkins | |
| 5,182,997 A | | 2/1993 | Bardsley | |
| 5,544,605 A | | 8/1996 | Frost | |
| 5,575,228 A | | 11/1996 | Padgett, III et al. | |
| 5,622,126 A | | 4/1997 | Card et al. | |
| 5,743,201 A | | 4/1998 | Card et al. | |
| 5,899,152 A | | 5/1999 | Bardsley et al. | |
| 5,983,815 A | | 11/1999 | Card | |
| 6,009,818 A | | 1/2000 | Card et al. | |
| 6,105,522 A | | 8/2000 | Kato | |
| 6,155,187 A | | 12/2000 | Bennett et al. | |
| 6,213,036 B1 | | 4/2001 | Slattery | |
| 6,244,203 B1 | | 6/2001 | Morgante et al. | |

(Continued)

FOREIGN PATENT DOCUMENTS

| | | |
|---|---|---|
| GB | 1 507 166 | 5/1975 |

(Continued)

*Primary Examiner*—Ismael Izaguirre
(74) *Attorney, Agent, or Firm*—Womble Carlyle Sandridge & Rice, PLLC

(57) ABSTRACT

A tufting machine includes a hook apparatus, which has gates and hooks. The hook apparatus has connectors that are coupled to the gates and actuators. The actuators can be actuated to move both the connectors and gates.

17 Claims, 6 Drawing Sheets

U.S. PATENT DOCUMENTS

| | | | |
|---|---|---|---|
| 6,260,493 | B1 | 7/2001 | Dean |
| 6,263,811 | B1 | 7/2001 | Crossley |
| 6,283,053 | B1 | 9/2001 | Morgante et al. |
| 6,439,141 | B1 | 8/2002 | Morgante et al. |
| 6,446,566 | B1 | 9/2002 | Bennett et al. |
| 6,502,521 | B1 | 1/2003 | Morgante et al. |
| 6,508,185 | B1 | 1/2003 | Morgante et al. |
| 6,516,734 | B1 | 2/2003 | Morgante et al. |
| 6,550,407 | B1 | 4/2003 | Frost et al. |
| 6,758,154 | B1 | 7/2004 | Johnston |
| 6,807,917 | B1 | 10/2004 | Christman et al. |
| 6,834,601 | B1 | 12/2004 | Card |
| 2004/0187268 | A1 | 9/2004 | Johnston |

FOREIGN PATENT DOCUMENTS

| | | |
|---|---|---|
| GB | 2 002 040 | 7/1978 |
| WO | WO 01/20069 | 3/2001 |
| WO | WO 2005/054561 | 6/2005 |

* cited by examiner

GATE ASSEMBLY FOR TUFTING MACHINE

CROSS-REFERENCE TO RELATED APPLICATIONS

This application claims priority to U.S. Provisional Application Ser. No. 60/525,761, filed Nov. 26, 2003.

BACKGROUND OF THE INVENTION

1. Field of the Invention

The present invention is related to a tufting machine, and more particularly, an improved gate assembly for a tufting machine.

2. Description of the Related Art

Tufting machines are widely used for manufacturing tufted pile fabrics, such as carpeting. Many such tufting machines include hook and gate mechanisms for creating loops.

Tufting machines have a plurality of yarn carrying needles. During operation the portions of the needles carrying the yarn pass though a heavy fabric to form loops of yarn below the fabric. The hook mechanism has loopers or hooks that are located below the fabric and are oscillated to capture loops of yarn so that when the needles are withdrawn from the fabric, the loop is held below the fabric to form loop pile. Many tufting machines have hundreds of these hooks, typically arranged in one or two rows over the entire width of the fabric.

Some tufting machine include knives that can be selectively actuated to cut loops to form cut pile and gates that can be extended to control whether the loop of yarn is cut by the knife. Conventional tufting machines have hundreds of gates, each of the gates located below one of the hooks. After the yarn is released from the hook by either the gate or the knife, the fabric can be advanced so that the yarn carrying needles can create the next set of loops. As such, the tufting machine can selectively generate both loop and cut pile.

Tufting machines have connectors that are coupled to the gates. Pneumatic cylinders are coupled to the connectors and actuated to move both the connectors and the gates. Due to the actuation of the pneumatic cylinders, connectors and the gates are particular vulnerable to wear, fatigue, and malfunctions.

When the hook apparatus malfunctions, the tufting manufacturing process is stopped for repair. For example, the connector and the gate may become uncoupled resulting in malfunctioning of the gate. If the gate malfunctions by not properly extending, the pile loop will not be released from the hook resulting in the production of flawed fabric. An operator can manually reconnect the connector to the gate.

SUMMARY OF THE INVENTION

In accordance with one embodiment of the present invention a connector can connect an output shaft of an actuator to a gate of a tufting machine. The connector comprises an actuator connector portion configured to be connected to an output shaft of an actuator. An extension portion extends upwardly from the actuator connector portion along a direction transverse to the axial direction and a gate connector slot extending from the extension portion and configured to engage the gate of the tufting machine. The gate connector slot includes lateral walls extending along lateral sides of a portion of the gate connected to the gate connector slot.

In another embodiment, a hook mounting arrangement for a tufting machine comprises a hook block rigidly that supports at least first and second hooks and slidably supports at least first and second gates adjacent to the respective first and second hooks. An actuator block supports at least first and second actuators disposed respectively in first and second vertically offset rows. A first connector comprises a first actuator connector portion connected to an output shaft of the first actuator, a first extension portion extends upwardly from the first actuator connector portion and a first gate connector slot extending from the first extension portion. A second connector comprises a second actuator connector portion connected to an output shaft of the second actuator, a second extension portion extends vertically downwardly from the second actuator connector portion and a second gate connector slot extending from the second extension portion. The first and second actuators are configured to reciprocally drive the first and second connectors in an axial direction, wherein the first and second actuator connector portions are respectively connected to the output shafts of the first and second actuators with sufficient rigidity to prevent rotation of the first and second connectors about a generally horizontal axis.

In another embodiment, a hook mounting arrangement for a tufting machine comprises a hook support rigidly supporting at least first and second hooks and slidably supporting at least first and second gates adjacent to the respective first and second hooks. An actuator block supports at least first and second actuators disposed respectively in first and second vertically offset rows. A first connector comprises a first actuator connector portion connected to an output shaft of the first actuator, a first extension portion extends vertically upwardly from the first actuator connector portion and a first gate connector slot extends from the first extension portion, the first gate connector slot including lateral walls extending adjacent to two lateral sides of the first gate. A second connector comprises a second actuator connector portion connected to an output shaft of the second actuator, a second extension portion extending vertically downwardly from the second actuator connector portion and a second gate connector slot extends from the second extension portion, the second gate connector slot includes lateral walls extending adjacent to two lateral sides of the second gate. The first and second actuators are configured to reciprocally drive the first and second connectors in an axial direction, wherein there is no additional guide contacting the first and second connectors for guiding the first and second connectors in the axial direction.

In another embodiment, a method of manufacturing a tufting machine comprises providing a fabric feed assembly for feeding a fabric appropriate for carpet in a feeding direction, mounting an array of needles for reciprocal motion along a needle direction which is transverse to the feeding direction, mounting a hook assembly for reciprocal motion in a hook direction which is transverse to the needle direction, aligning a plurality of hooks on the hook assembly with the needles, mounting a plurality of gates in alignment with the plurality of hooks for reciprocal motion relative to the hooks, mounting an array of actuators in alignment with the plurality of gates, connecting the actuators to the gates with a plurality of connectors being rigidly mounted to the actuators, having extension portions extending from the actuators in a direction transverse to the hook direction to an end of the gates, and having a pair of lateral walls extending along lateral sides of the ends of the gates.

DETAILED DESCRIPTION OF THE PREFERRED EMBODIMENT

Figure 1:
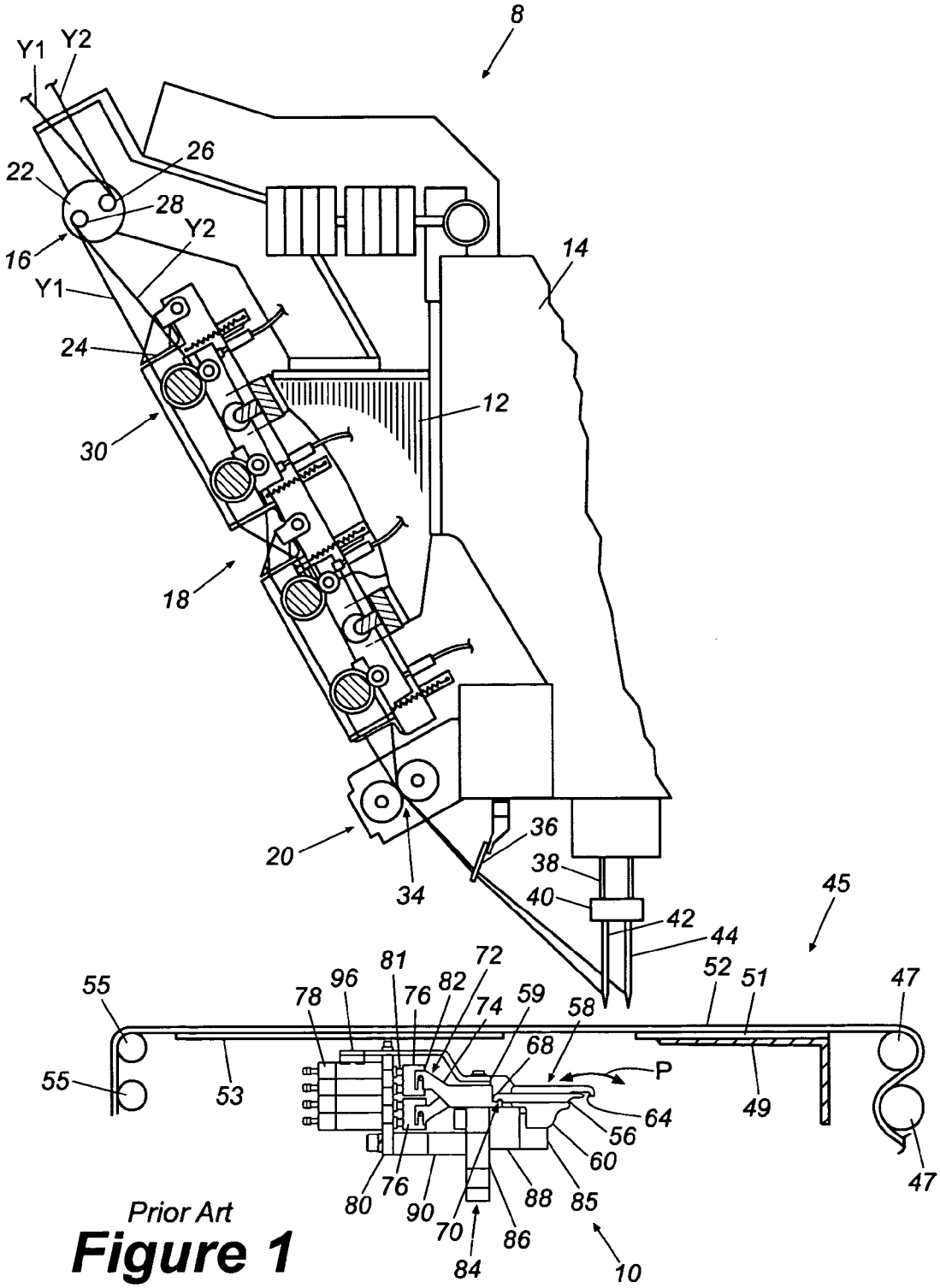
Prior Art Figure 1
FIG. 1 is a partial and side elevational view of a known tufting machine with a hook apparatus, the tufting machine having a full repeat scroll attachment having two pairs of yarn fee rollers and corresponding sets of yarn wheel pitman arms.

With reference to FIG. 1, an overall configuration of a known tufting machine 8 with a hook apparatus 10 is described to assist the readers understanding of a preferred environment of use of the present inventions. The tufting machine 8 is described in reference to a coordinate system wherein a longitudinal dimension of the machine 8 extends in a direction generally horizontally and transversely to the direction through which yarn is fed through the machine 8. In addition, relative heights are expressed as elevations in reference to the undersurface of the machine 8.

Generally, the machine 8 includes a frame assembly 12, a needle head assembly 14, a yarn inlet 16, a yarn feed assembly 18, and a yarn outlet assembly 20. In the illustrated machine 8, the inlet 16, yarn feed assembly 18, and the outlet 20 define a scroll attachment of the tufting machine 8. The head 14, inlet 16, feed assembly 18, and the outlet 20 are supported by the frame 12. The frame 12 includes a number of load bearing members, brackets, and legs for supporting the head 14, inlet 16, feed roller assembly 18, and outlet 20.

The inlet 16, feed assembly 18, and outlet 20 are configured to guide a plurality of yarn strands from the yarn supply (not shown) to the lower end of the needle head 14. The yarn strands Y1, Y2, illustrated in FIG. 1, each represent an array of yarn strands fed from the yarn supply. The arrays of yarn strands Y1, Y2 are interlaced so as to alternate along the longitudinal length of the machine 8, as known in the art.

The inlet 16 includes a tensioner 22 and a strand guide 24. The tensioner 22 includes a pair of guide rods 26, 28 that can be rotated relative to each other to adjust the tension in the yarn strands Y1, Y2. The yarn guide 24 separates the yarn strands Y1 from the yarn strands Y2.

The feed assembly 18 includes a first drive roller assembly 30 and a second drive roller assembly 32. The first drive roller assembly 30 is configured to control the feeding of yarn strand Y2. The second feed roller assembly 32 is configured to control the feeding of yarn strand Y1.

The outlet 20 includes a nip roller assembly 34 and a jerker 36. The construction and operation of the nip roller 34 and the jerker 36 are known in the art and are not described further.

The needle head 14 includes the plurality of spaced push rods 38 which are reciprocally mounted within the head 14. A needle bar 40 is mounted at the lower ends of the push rod 38. The needle bar 40 (shown in a side elevational view only) extends over the entire width of the fabric being fed to the machine 8. Thus, a machine having, for example, a 15 foot long needle bar 40, can output a continuous stream of carpet, 15 feet wide.

The needle bar 14 supports at least one row of needles. In the illustrated embodiment, the needle bar supports two rows of needles 42, 44. The needles 42, 44 reciprocate, up and down, along with the push rods 38 and needle bar 40. The yarn strands Y1, Y2 are arranged in the machine 8 such that the upper feed roller assembly 30 controls the feed of yarn strand Y1 to the needles 42 and the lower feed roller assembly 32 controls the feed rate of the yarn strands Y2 to the needle 44. The needles 42, 44 cooperate in a conventional manner with the hook apparatus 10 mounted beneath the head 14 to process a fabric 52, which is feed and supported by a fabric feed structure 45.

The fabric feed structure 45 includes a plurality of input rollers 47, a support base 49, support plates 51, 53, and a plurality of output rollers 55.

The input rollers 47 are configured to control the feeding of the fabric 52. The input rollers 47 can rotate to feed the fabric 52 to the machine 8. The rotational speed of the input rollers 47 can be varied for a corresponding feed rate of the fabric 52. Those skilled in the art recognize that the feed rate of the fabric 52 can be varied when producing different types of tufted pile fabric.

The support base 49 is coupled to the bottom of the support plate 51 and supports the support plate 51. The support plate 51 is configured to support to the fabric 52 which forms a backing of a carpet product. The fabric 52 can be fed from the input rollers 47 and across the upper surface of the support 51 to the reciprocating needles 42, 44, which are configured to cooperate with the hook apparatus 10. A portion of the needles 42, 44 carry the yarn strands Y1, Y2 and pass through the fabric 52 to form loops of yarn below the fabric 52. As the portion of the needles 42, 44 and the yarn strands Y1, Y2 are passed though the fabric 52 towards the apparatus 10, the support plate 51 limits movement of the fabric 52 in the direction towards the apparatus 10.

The support plate 53 is also configured to provide support to the fabric 52. The fabric 52 can pass across the upper surface of the support plate 53 towards the output rollers 55. The output rollers 55 are configured to receive the fabric 52, which has been processed by the machine 8.

Figure 1A:
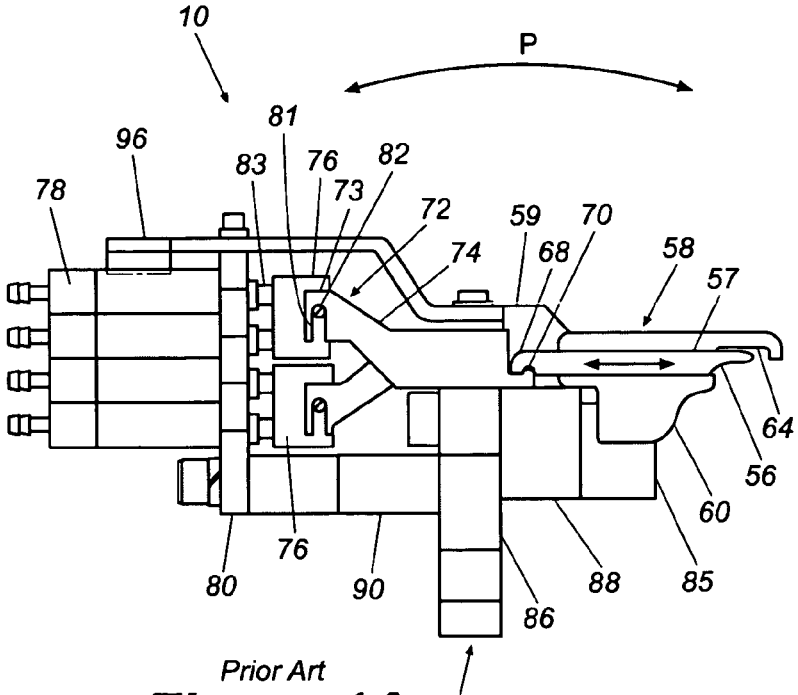
Prior Art Figure 1A
FIG. 1A is an enlarged side elevational view of the known hook apparatus shown in FIG. 1, the hook apparatus having a plurality of gates and hooks.

With reference to FIG. 1 and FIG. 1A, the known hook apparatus 10 includes a plurality of loopers or hooks 58 and a plurality of gates 56 that are mounted within a slotted module 60. The hook apparatus 10 is pivotally mounted relative to the frame 12, so as to pivot about a pivot axis that extends generally parallel to the needle bar 40. An actuator (not shown) drives the apparatus 10 so as to reciprocate about the pivot axis, along the direction of arrow P, in accordance with a desired timing.

Although only one hook 58 is shown in FIG. 1, the hook apparatus 10 includes one hook 58 for each needle 42, 44 on the needle bar 40. Additionally, although not illustrated, where the needles are arranged in two rows, hooks of different lengths can be mounted in an alternating fashion such that the hooks of a first length are aligned with the needles 42, and the other hooks are aligned with the needles 44.

Each hook 58 has a bill 64 sized and shaped for entering into and capturing the loops formed from the yarn strands Y1, Y2 when the distal end the needles 42, 44 pass through the fabric 52. The hooks 58 can seize the loops by passing between the needles 42, 44 and the yarn strands Y1, Y2 thereby passing through the loops formed from the yarn strands Y1, Y2.

The gates 56, when in the closed position, are configured to release the loops of yarn Y1, Y2 from the hooks 58 to form pile loop. For example, when the gates 56 are closed and when the assembly 10 is pivoted away from the needles 42, 44, a loop of yarn initially captured by the hook 58 and gate 56 is released, thereby leaving an intact loop.

The movement of the gate 56 is controlled by an actuator operatively controlled by the gate 56. The gates 56 have a notch end 68 which is coupled to a notch end 70 of a connector assembly 72. The gates 56 are slidably mounted with a slot 57, which is formed in the module 60, to open and close the bill 64 of the hook. The notched end 58 of the gate 56 is connected to the connector assembly 72.

The connector assembly 72 includes a connector 74 and a block 76. The connector assembly 72 is coupled the gate 56 and to a pneumatic cylinder 78. The apparatus 10 can have a plurality of connector assemblies 72, each connector assembly 72 corresponding to one of the gates 56.

The connector 74 includes a block end 73 and the notch end 70. The block end 73 has a slot 81 that is engaged with a pin 82 in the block 76. The notch end 70 is configured to engage the notch end 68 of the gate 56. The block 76 is coupled to an output rod 83 of the respective pneumatic cylinder 78.

The pneumatic cylinders are mounted in four tightly spaced rows, horizontally offset from each other, with the cylinder 78 supported in a cylinder support frame 80. Each pneumatic cylinder 78 moves a corresponding output rod 83 to move the connector assembly 72 and the gate 56.

As noted above, the connector 74 and gate 56 engage each other through the engagement of the notched ends 68, 70. In order to maintain the proper alignment of the ends 68, 70, and to ensure the ends 68, 70 do not move laterally relative to each other, a comb 59 is disposed between the slotted module 60 and the block 76. The comb includes a plurality of upwardly opening channels, aligned with and having approximately the same width as the slots in the module 60. As such, the notched ends 68, 70 can reciprocate within the channels of the comb 59, whereby the channels maintain the proper lateral alignment of the ends 68, 70. Because the channels of the comb 59 open upwardly, the connectors 72 can be removed from the comb 59 by being lifted vertically out of the channels.

A cover member 96 is connected to the frame 80. The cover member 96 protects the hook apparatus 10 from lint present in the environment in which the apparatus 10 operates. Additionally, the cover member 96 prevents the connectors 72 from inadvertently sliding upwardly out of the open channels of the comb 59.

With continued reference to FIG. 1A, a mounting bracket assembly 84 includes a mounting bar 85, a support member 86, and the cylinder support frame 80. The mounting bar 85 can be connected to the support member 86 by means of a spacer member 88 therebetween. The support member 86 is in turn connected to the cylinder support frame 80 by another spacer member 90.

The mounting bracket assembly 84 is connected to an oscillating arm, not shown, which causes the mounting bracket assembly 84 to oscillate in a pivotal motion along arrow P as known in the art. For example, after the loop of yarn is formed under the fabric 52, the hook apparatus 10 can be pivoted toward the needles 42, 44 so that the hook 58 passes between a yarn strand and a corresponding needle to thereby capture or snag the yarn. The corresponding needle is then retracted upwardly, pulling the yarn with a desired tension against the hook. After the needles 42, 44 are moved above the fabric 52, the hook apparatus 10 can be pivoted away from the loop at a desired timing, to thereby leave a loop of yarn.

When it is desired to cut a loop, the appropriate cylinder 78 is actuated to retract the gate 56 to an open position, thereby exposing the bill 64 of the gate 56. With the bill 64 exposed, the yarn strand can be pulled against the tapered part of the bill 64, then cut with a knife (not shown).

This process can be repeated at high speed to form tufted pile fabric. Additionally, each gate 56 can be selectively actuated so that any individual loop can be cut or left whole.

The hook apparatus 10 and mounting bracket assembly 84 which oscillate together and are typically made of steel. Thus, it may be readily understood that since all of these elements are constructed from steel, a very heavy mass must be oscillated. Additionally, the multitude of elements require substantial assembly time during manufacture and both disassembly and assembly time during maintenance.

Figure 2:
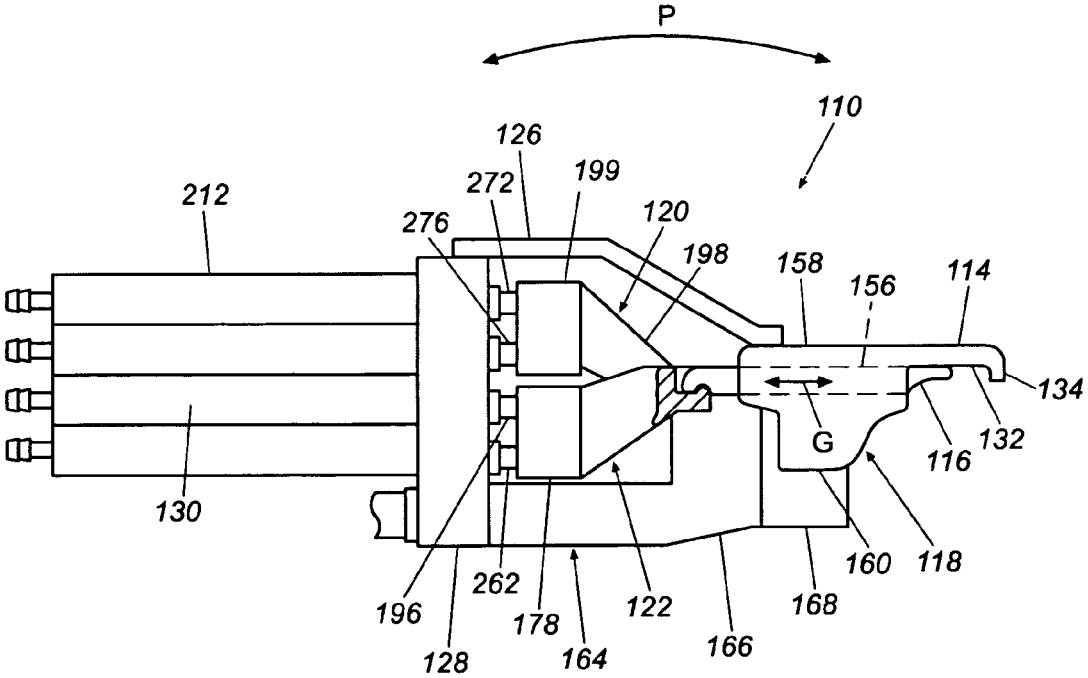
FIG. 2 is a partial sectional view of a hook apparatus with gates and hooks.

FIG. 2 is partial sectional view of a hook apparatus 110 constructed in accordance with a preferred embodiment. Certain portions of the apparatus 110 can be constructed in a manner similar to that of the apparatus 10, and thus, the description of those portions is not repeated. The hook apparatus 110 of the present embodiment includes a hook 114, a gate 116, a hook block 118, connectors 120, 122, a cover 126, an actuator block 128, and an actuator 130.

The hook 114 is an elongated body that comprises an edge 132 and a bill 134 at one end. The edge 132 is formed by the lower portion of the hook 114.

The bill 134 is located at one end of the hook 114 and extends transverse to the longitudinal axis of the hook 114. The edge 132 and bill 134 are configured to engage with a loop formed by yarn strands Y1 and/or Y2.

Figure 3:
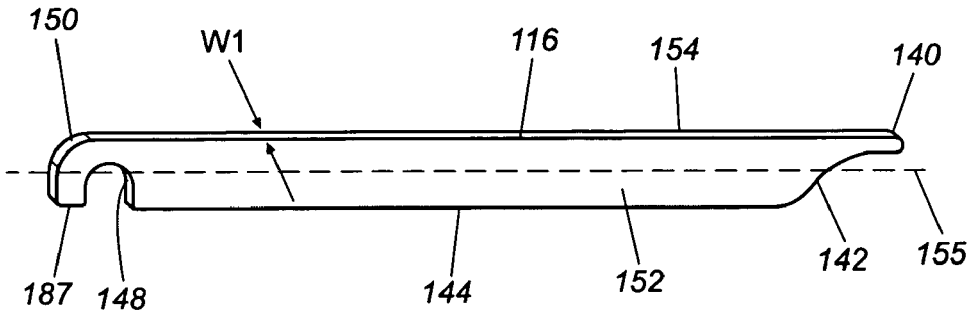
FIG. 3 is an enlarged perspective view of the gate illustrated in FIG. 2.

With reference to FIG. 2 and FIG. 3, the gate 116 comprises a tip 140, an edge 142, a body 144, a notch 148, a connector gate end 150, and a pair of lateral sides 152, 154. The gate 116 can move in the directions indicated by the arrows G shown in FIG. 2. In one embodiment, the gate 116 has a longitudinal axis 155 and a substantially uniform thickness or width W1 and preferably is formed of metal, such as steel or aluminum.

The tip 140 is tapered and sized to conveniently pass through a loop of yarn. The edge 142 is curved and is configured to, with the gate 56 in the closed position, capture or engage a loop of yarn when the assembly 110 is pivoted toward the needles 42, 44, and to allow the loop to slide off when the assembly 110 is pivoted away from the needles 40, 42.

The notch 148 is configured to couple the gate 116 to the connector 122. In the illustrated embodiment, the notch 148 is located at the connector gate end 150 of the gate 116. The gate 116 is sized such that the connector gate end 150 and notch 148 extend rearwardly from the hook block 118, so as to engage with the connector 122.

With respect to FIG. 2, the hook block 118 includes a plurality of slots 156, an upper portion 158, and a lower portion 160. The hook block 118 can be formed of metal, such as steel, aluminum, hard plastics, and the like.

Each of the slots 156 surrounds and slidably engages with the gate 116 such that a plurality of the gates 116 can reciprocate in the direction of the longitudinal axis of the slots 156. Each of the plurality of slots 156 can be spaced apart in the direction perpendicular to the plane defined by one of the gates 116. In one embodiment, the longitudinal axis of the slots 156 are generally parallel. The slots 156 can have a substantially rectangular profile and are configured to inhibit substantial movement of the gate 116 in a direction transverse to the longitudinal axis of the slots 156.

The upper portion 158 of the hook block 118 is rigidly coupled to the hooks 114 and thus the hook block 118 and hooks 114 move together when the assembly 110 is pivoted. The lower portion 160 is rigidly coupled to the upper portion 158 and a support bar 164 and thus the hook block 118 and the support bar 164 also move together.

The support bar 164 includes a spacer 166, a mounting bar 168, and the actuator block 128. The mounting bar 168 is coupled to the hook block 118 and the spacer 166. The spacer 166 is coupled to the actuator block 128. The support bar 164 can be pivotally mounted so as to reciprocate in the direction of arrow P as is known in the art and is not described further. Preferably, the spacer 106 is rigidly coupled to the mounting bar 168 and the actuator block 128.

Figure 4:
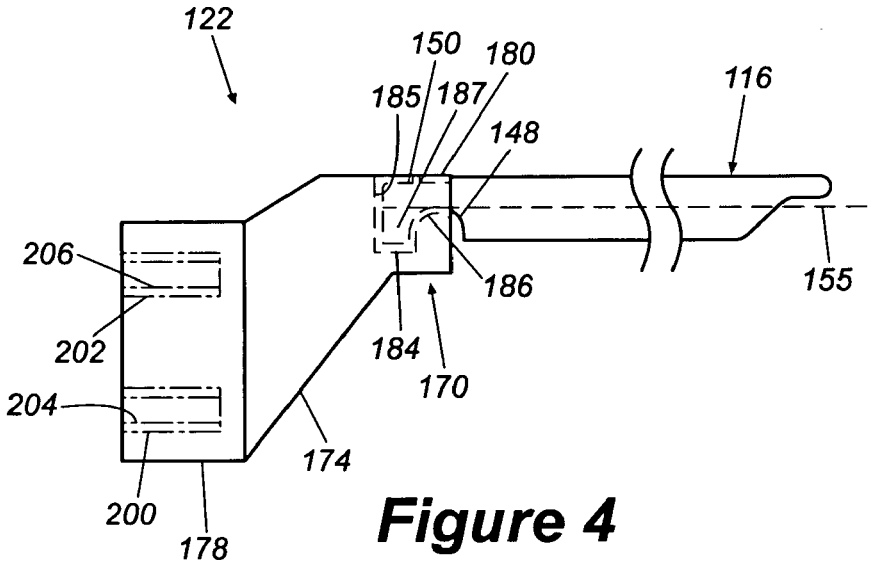
FIG. 4 is an enlarged side elevational view of the gate and connector shown in FIG. 2, the connector is not coupled to a gate.

With reference to FIG. 2 and FIG. 4, the connector 122 includes a slot portion 170, an extension portion 174, and an actuator connector portion 178.

The slot portion 170 is coupled to the connector gate end 150 of the gate 116. The slot portion 170 is connected to the extension portion 174 and defines a gate connector slot 180. The slot portion 170 is coupled to the connector gate end 150 by the extension portion 174 during both reciprocation of the gate 116 and oscillation of the hook apparatus 110.

As shown in FIG. 4, a lower portion 187 of the connector gate end 150 is disposed within a recess 184 between a notch portion 186 and a back surface 185 of the connector 122. Thus, the lower portion 187 can be located between a pair of walls 181, 182. Preferably, the notch portion 186 and the back surface 185 engage with the lower portion 187 and prevent substantial movement of the gate 116 in the direction of its longitudinal axis 155 relative to the connector 122. In one embodiment, a portion of the longitudinal axis 155 of the gate 116 is disposed between at least a portion of the walls 181, 182 when the connector 122 is coupled to the gate 116.

The recess 184 can engage with the lower portion 187 of the connector gate end 150, and the notch 148 of the gate 116 can receive and accommodate the notch portion 186 of the connector 122. Preferably, the notch 148 and the notch portion 186 have a similar shape. For example, in the illustrated embodiment, both a portion of the notch 148 and a portion of notch portion 186 have a semicircular shape such that the notch 186 fits within the notch 148.

The extension portion 174 connects the slot portion 170 and the actuator connector portion 178. In the illustrated embodiment, the gate 116 has a longitudinal axis that is not parallel to the longitudinal axis of the extension portion 174. In one embodiment, the extension portion 174 extends vertically upwardly from the actuator connector portion 178 along a direction transverse to the longitudinal axis of the actuator 130. In the illustrated embodiment, the extension portion 174 has substantially rectangular cross sectional profile that varies along its longitudinal axis. Although not illustrated, the extension portion 174 can have a cross sectional profile that is generally uniform along its longitudinal axis.

With continued reference to FIG. 4, the connector 122 has a pair of holes 200, 202 that are configured to receive one end of the output shaft 196. For example, the holes 200, 202 can have threads 204, 206, respectively, so that they can be threadedly coupled to an output shaft (e.g., the output shaft 196). Preferably, the actuator connector portion 178 is rigidly connected to the output shaft 196 to inhibit rotation of the connector 122 relative to the output shaft 196.

Advantageously, the output shaft 196 can move the connector 122 and the gate 116 without substantial movement of the connector 122 relative to the gate 116 because of the rigid connection between the output shaft 196 and the connector 122. Thus, the rigid connection between the output shaft 196 can reduce wear between the connector 122 and the gate 116.

In the illustrated embodiment, the connector 122 is a unitary body that can be formed, for example, from metal or plastic. In one embodiment, the connector 122 is formed of plastic through an injection molding process.

Figure 4A:
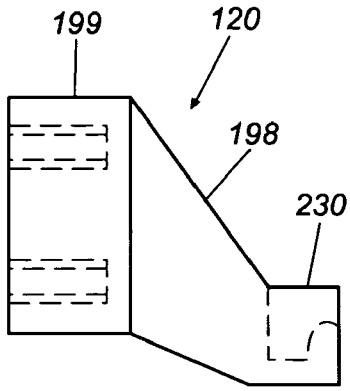
FIG. 4A is a side elevational view of the connector shown in FIG. 2, the connector is not coupled to a gate.
Figure 7:
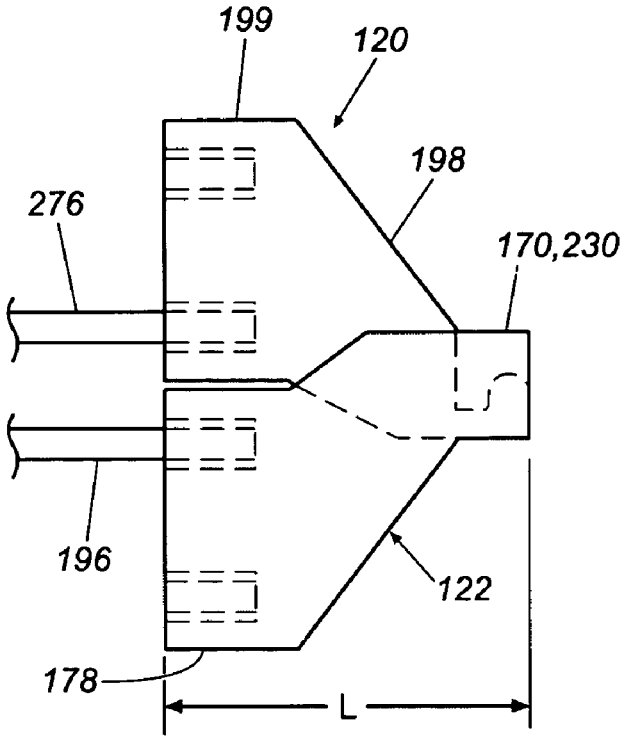
FIG. 7 is a side elevational view of the connectors shown in FIGS. 4 and 4A, each of the connectors is coupled to an output rod.

With respect to FIG. 4A, the connector 120 includes the slot portion 230, an extension portion 198, and the actuator connector portion 199. The extension portion 198 is coupled to the slot portion 230 and the actuator connector portion 199. The extension portion 198 extends vertically downwardly from the actuator connector portion 199 to the slot portion 230. The slot portions 170, 230 of the connectors 122, 120, respectively, can be aligned horizontally, as shown in FIG. 2 and FIG. 7. As such an array of the connectors 120, 122 can be disposed in an alternating, side-by-side relationship so as to form a tightly nested arrangement.

Figure 5:
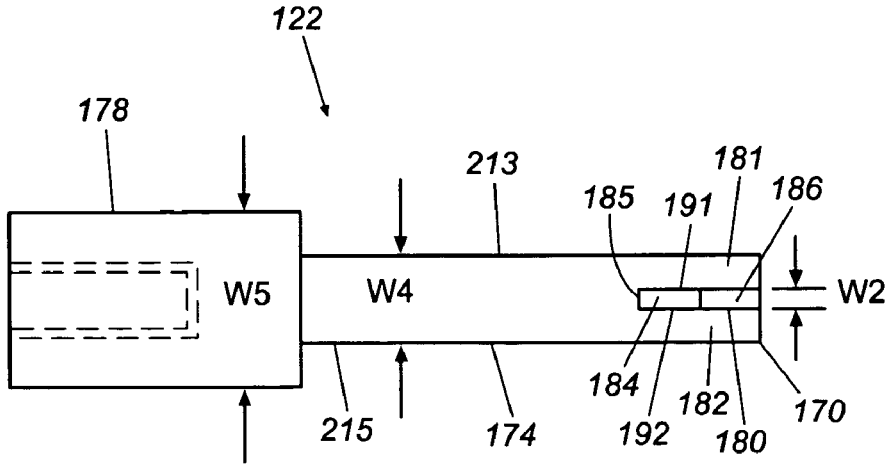
FIG. 5 is a top plan view of the connector shown in FIG. 2, the connector is not coupled to a gate.

With reference to FIG. 4 and FIG. 5, the gate connector slot 180 of the connector 120 has pair of lateral walls 181, 182, the recess 184, the back surface 185, and the notch portion 186. When the gate 116 is coupled to the connector 122, the each of lateral walls 181, 182 extends along a portion of the lateral sides 152, 154 of the gate 116.

The walls 181, 182, have inner surfaces 191, 192, respectively, that are spaced apart to prevent substantial lateral movement of the gate 116. The connector gate end 150 is preferably disposed within the gate connector slot 180 which inhibits substantial movement of the connector gate end 150 in the direction perpendicular to the inner surfaces 191, 192. In one embodiment, the thickness of the wall 181 and the thickness of the wall 182 are substantially the same. The walls 181, 182 can be sized to prevent substantial rotation of the gate 116 about the longitudinal axis of the gate 116. Thus the portion of the gate 116 extending from the hook block 118 to the connector 122 is generally aligned with the slots 156.

The walls 181, 182 can be configured such the connector 122 can reciprocate the gate 116 for extended periods of time without compromising the structural integrity of the connector 122 while also maintaining proper alignment of the gate 116. In one embodiment, the gate connector slot 180 has a width W2 that is greater than the width W1 (as shown in FIG. 3) of the gate 116. In an exemplary embodiment, the width W2 (FIG. 5) can be less than about 0.003 inches (0.0762 mm) greater than the width W1, and more preferably less than about 0.002 inches (0.0508 mm) greater than the width W1. For example, in one embodiment, the width W2 is about 0.001 inches (0.0254 mm) greater than the width W1. Advantageously, the gate connector slot 180 can be configured such that it can be coupled to conventional gates.

Many known connectors are made of metal, such as steel. The reciprocating speed of the gate and connector is related to the mass of the connector. Thus, a heavy connector can result in a reduced reciprocating speed of the gate, resulting in reduced production rates of the tufted pile fabrics. In order to reduce the mass of the connectors, known connectors have been formed from metal and plastic and can be produced by a complicated multi-step process. The metal portion of the connector is machined and then plastic portion is molded to the metal portion. Advantageously, the connector 122 is preferably formed by molding a plastic resulting in reduced production cost. Further, the plastic connector 122 can be reciprocated at high speeds because of its mass can be lower than many known connectors made of steel. The other components of the apparatus 110 can be made of a light weight material, such as aluminum, to further increase the pivot speed of the apparatus 110.

In an exemplary embodiment, the connector 122 preferably can have a length L (as shown in FIG. 7) in the range of about 0.5 inches to 1.5 inches (12.7 mm to 38.1 mm). More preferably, the connector 122 can have a length L in the range of about 0.75 inches to 1 inch (19.05 mm to 25.4 mm).

Figure 6:
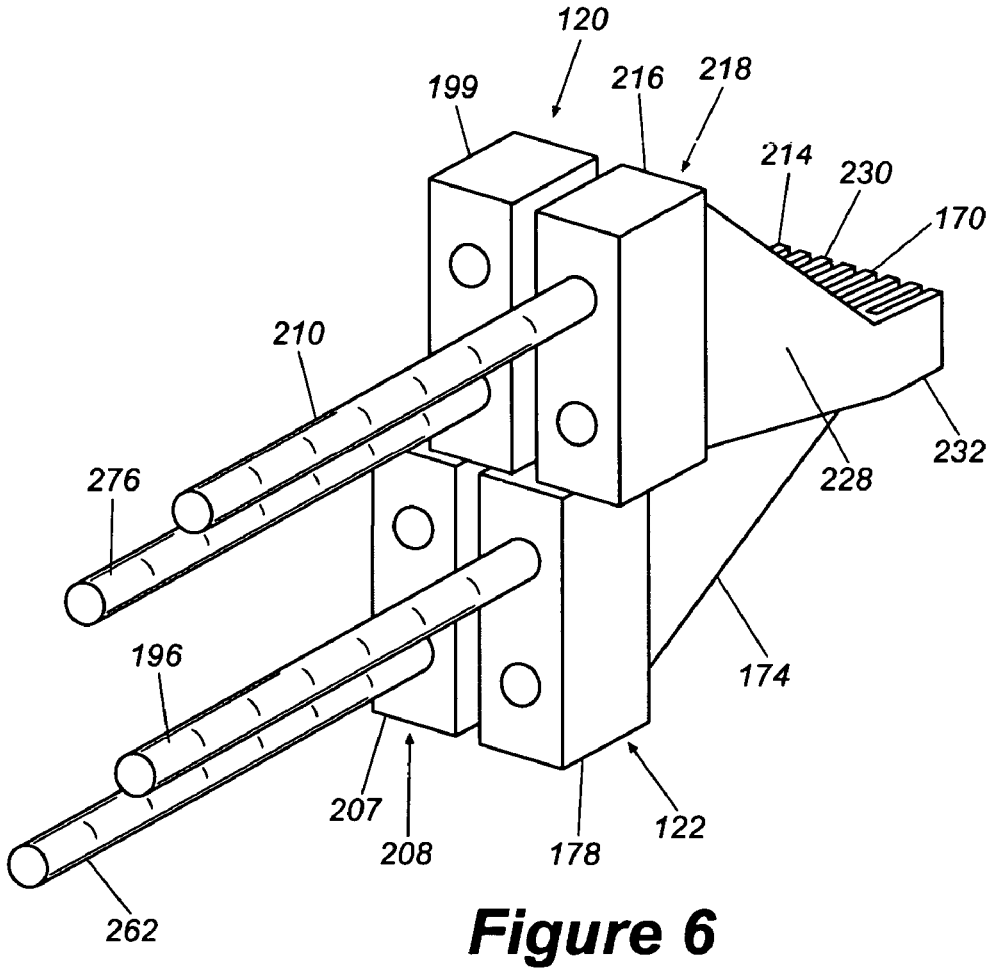
FIG. 6 is a perspective view of a plurality of connectors, each of the connectors is coupled to an output rod.

With respect to FIG. 5 and FIG. 6, the extension portion 174 and slot portion 170 have substantially the same width W4 and form a pair of surfaces 213, 215. A further advantage is provided where the actuator connector portion 178 has a width W5 that is greater than W4. The output shaft 196 of the actuator 130 can have a diameter greater than W4.

Advantageously, the actuators which are coupled to the connectors are mounted in four tightly spaced rows, horizontally offset from each other. The connector 122 can be coupled to the output shaft 196 of the actuator 130 while a substantially identical adjacent connector is coupled to another output shaft.

For example, as shown in FIG. 6, rows of upper and lower connectors are shown in which the connector 120 is adjacent to another connector 218 that is substantially identical to the connector 120, forming an upper row of connectors. The connector 122 is disposed adjacent to another connector 208 that is substantially identical to the connector 122, so as to form a lower row of connectors. These upper and lower rows of connectors are arranged as they would be when mounted to corresponding actuators supported by the actuator block 128 which has been removed from this figure for purposes of illustration. As noted above, the connectors 208 and 218 are substantially identical to the connectors 122 and 120, respectively. However, the description of the components of the connectors 208 and 218 that correspond to the components of the connectors 122 and 120 are repeated below for the reader's reference in reference to FIG. 6.

As shown in FIG. 6, the actuator connector portion 199 of connector 120 is adjacent to an actuator connector portion 216 of the connector 218. The actuator connector portion 207 of connector 208 is adjacent to the actuator connector portion 178 of the connector 122. The actuator connector portion 199 is located above and between the actuator connector portions 207, 178. The actuator connector portion 178 is located below and between the actuator connector portions 199, 216. The actuator connector portions 199, 207, 216, 178 are coupled to output shafts 276, 262, 210, 196, respectively.

Further, the output shafts connected to adjacent actuator connector portions are horizontally offset. Thus, the upper hole of the actuator connector portion 216 and the lower hole of the actuator connector portion 199 are connected to output shafts 210, 276, respectively. Similarly, the upper hole of the actuator connector portion 178 and the lower hole of the actuator connector portion 207 are connected to output shafts 196, 262, respectively.

Figure 8:
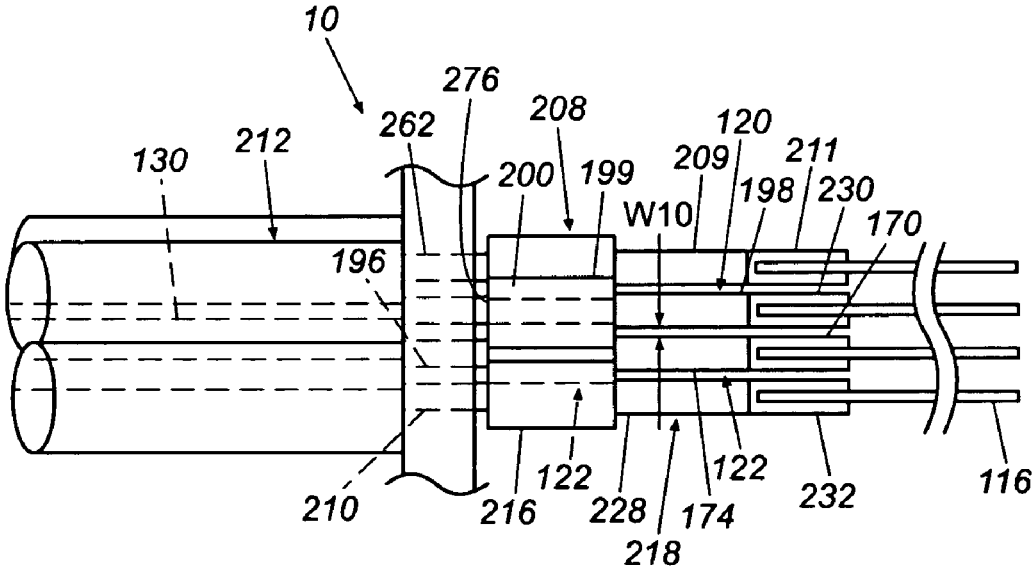
FIG. 8 is a top plan view of a portion of the hook apparatus illustrated in FIG. 2.

As shown in FIGS. 6 and 8, the extension portions 228, 198, 174, 209 are interleaved with each other so that the slot portions 170, 230, 214, 232 of connectors 122, 120, 208, 218, respectively, can be disposed side-by-side so as to align the gates 116 with their respective slots 156.

For example, the connectors 218, 120 have extension portions 228, 198 that extend downwardly to the slot potions 232, 230. The connectors 122, 208 have extension portions 174, 209 that extend upwardly to the slot portions 170, 211. FIG. 7 also illustrates the connector 120 and 122 having slot potions 230, 170 arranged side-by-side. FIG. 8 shows the gates 116 extending substantially parallel. Further, the output shafts 196, 210, 262, 276 are configured so that their respective actuators are in four tightly spaced rows.

Figure 9:
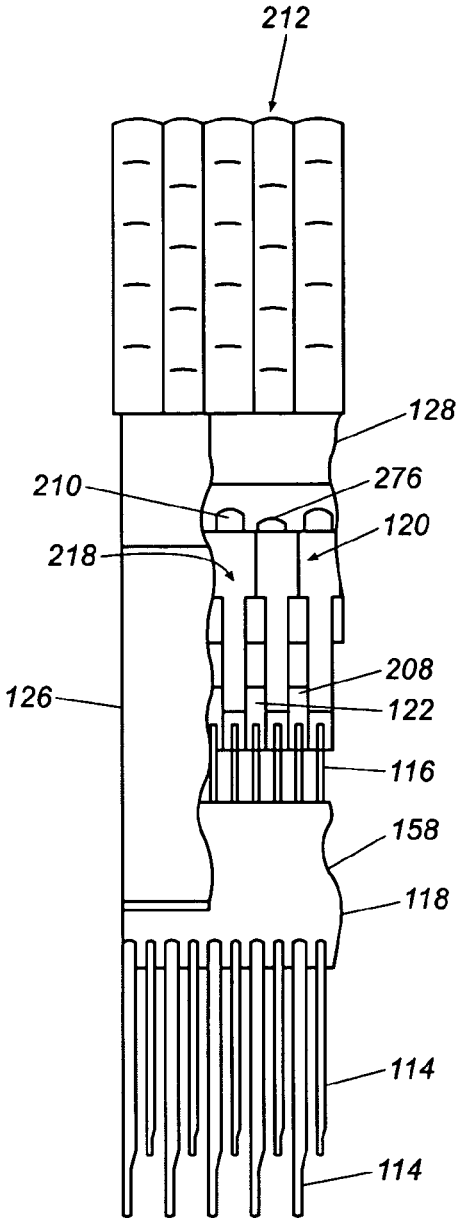
FIG. 9 is a top plan view of a portion of the hook apparatus illustrated in FIG. 2, a portion of the cover is shown.

With reference to FIGS. 6, 8 and 9, the connectors can be spaced to prevent damage to the apparatus 110 if the connector and gate become uncoupled. For example, the distance W10 between the extension portion 198 and the extension portion 174 is preferably less than the width W1 (FIG. 3) of the gate 116. Advantageously, because the extension portions of connector 120 and the connector 122 are separated by a distance less than W1, the gate 116 may not fit between the connectors 120, 122. Thus, if the gate and connector become uncoupled, the gate will not become caught between the connectors and thus prevent damage the hook apparatus 110. Further, adjacent slot portions can contact each other to limit lateral movement of each other. For example, the slot portion 170 of the connector 122 can contact the slot portion 232 of the connector 218 and a slot portion 230 of the connector 120 to ensure proper alignment of the connectors 120, 122, 218. Moreover, all of the connectors can reciprocate independently of each other.

With continued reference to FIGS. 8 and 9, the hook apparatus 110 has a plurality of the gates 116 are connected to the connectors 120, 122, 208, and 218. Each of the gates 116 have longitudinal axis, which are substantially parallel and generally aligned with respective slots 156 the hook apparatus 110.

In other tufting machines the connectors are particularly vulnerable to wear, fatigue, and vibrations because of the connectors not securely holding the gates 116. For example, in FIG. 1 and FIG. 1A, the notch end 70 of the connector 74 is coupled to the notch end 68 of the gate 56. The block end 73 of the connector 74 has the slot 81 that is configured to couple to the pin 82 of the block 76. The connector 74 typically has a thickness which is slightly greater than the thickness of the gate 56.

Because a plurality of gates 56 are side-by-side and spaced apart, the connectors and gates 56 can move laterally relative to each other, such that the notch end 68 of the gate 56 and notch end 70 of the connector 74 become uncoupled. Thus, as noted above, the conventional apparatus 10 includes the comb 59 so prevent such lateral relative movement.

By including the lateral walls 181, 182 at the slot portion 170, the comb 59 of the conventional apparatus 10 is no longer necessary to maintain the alignment of the connector gate end 150 and the slot portion 170. Additionally, by incorporating the transversely extending extension portion 174, the connectors 122 can be used with the relatively larger, but more easily serviceable individual actuators 130, 212, 270, 274, which can be arranged in four different rows, described in greater detail below.

With reference to FIGS. 2 and 9, the cover 126 has one end connected to the actuator block 128 and the other end connected to the end to the top of the upper portion 158. The cover 126 protects the hook apparatus 110 from lint due to the environment in which the apparatus 110 operates.

Figure 10:
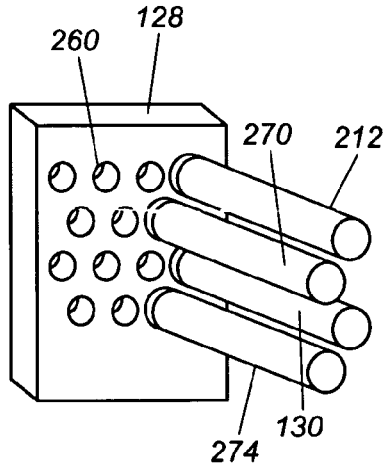
FIG. 10 is a perspective view of a portion of an actuator block shown in FIG. 2, the actuator block is partially filled with actuators.

With reference to FIGS. 6 and 10, the actuator block 128 includes a plurality of holes 260 through the actuator block 128. FIG. 10 provides a view of a portion of the actuator block 128 partially filled with actuators.

The holes 260 are arranged and configured such that each of the output shafts 196, 210, 262, 276 can respectively reciprocate through the holes 260. The holes 206 are arranged in four rows that are horizontally offset and staggered, as shown in FIG. 10.

Each of the holes 206 preferably has a longitudinal axis that is substantially parallel to the longitudinal axis of the other holes 206. Preferably, each of the output shafts 196, 210, 262, 276 has a longitudinal axis that is substantially parallel to the longitudinal axis of the other output shafts. In the illustrated embodiment, portions of the output shafts 196, 210, 262, 276 are disposed within the hole 260 while portions of the output shafts 196, 210, 262, 276 extend from both sides of the actuator block 128. In one embodiment, the holes 260 and the output shafts 196, 210, 262, 276 have a generally circular cross sectional profile that is constant along their respective longitudinal axis. The actuators 130, 212, 274, 270 include the output shafts 196, 210, 262, 276, respectively. The actuators 130, 212, 274, 270 can be any type of actuator, including, for example, but without limitation, solenoid, hydraulic, or pneumatic.

Figure 11:
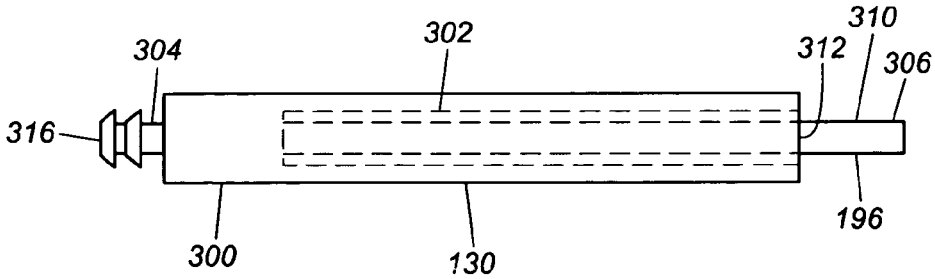
FIG. 11 is a side elevational view one of the actuators shown in FIG. 2, the actuator having an output shaft.

With reference to FIG. 11, the actuator 130 is in the form of a pneumatic actuator that includes the output shaft 196, a cylindrical actuator body 300, a spring 302, and a coupler 304. The actuator 130 has a longitudinal axis in an axial direction. The output shaft 196 has an end 306 that is configured such that it can be coupled to the actuator connector portion 199 while a portion 308 of the output shaft 196 is disposed within the cylindrical actuator body 300.

The cylindrical actuator body 300 surrounds the spring 302 and the portion 308 of the output shaft 196. The actuator body 300 has one end connected to the coupler 304. The other end of the actuator body 300 has an opening 312. A portion 310 of output shaft 196 can pass through the opening 312, as shown in FIG. 11. Thus, the output shaft 196 has the portion 308 disposed within the cylindrical actuator body 300 and the portion 310 extending from the actuator body 300.

The spring 302 is coupled to the cylindrical actuator body 300 and the output shaft 196. The spring 302 biases the output shaft 196 inwardly.

The coupler 304 is in the form of an air hose coupler having a nipple 316. Although not shown, an air hose can have an air hose nipple coupler that can be attached to the nipple 316 so that air hose can feed air through the coupler 304 and into the actuator 130. Air can be feed into the actuator 130 to increase the air pressure within the actuator 130, which provides an outward force to the output shaft 196, within the actuator body 300.

The output shaft 196 has its longitudinal axis that is preferably coaxial with the longitudinal axis of the actuator body 300 and parallel with the longitudinal axis of the gate 116. In one embodiment, the end 306 comprises threads that can be coupled to the threaded holes of the connector. The output shaft 196 is reciprocated by cooperation of the spring 302 and the air hose. The output shaft 196 biases outwardly when the air hose is attached to the nipple 316 and feeds air through the coupler 304 and into the actuator body 300 such that outward force provided by the air pressure in the actuator body 300 is greater than the spring bias. As the output shaft 196 moves outward, the output shaft 196 moves the connector 122 and the gate 116 away from the actuator block 128.

When the spring bias is greater than the outward force provided by the air pressure in the actuator body 300, the output shaft 196 biases inwardly. As the output shaft 196 moves inward, the output shaft 196 moves the connector 122 and the gate 116 towards the actuator block 128. Thus, the output shaft 196 is reciprocated by the cooperation of the air hose causing the output shaft to move outwardly and the spring causing the output shaft 196 to move inwardly.

The actuator 130 and the output shaft 196 are configured to substantially inhibit movement of the connector 122 in the direction transverse to the axial direction when the connector 122 is reciprocated. Thus, during the tufting process, the movement of the connector 122 in the direction transverse to the axial direction is less than the movement of known connectors in the direction transverse to the axial direction in conventional tufting machines because of the length of the actuator 130 and output shaft 196 being greater than the length of many known pneumatic cylinders 78. Further, many known tufting machines use pneumatic cylinders 78 that are made of steel. These cylinders are heavy resulting in low reciprocating speeds of output shafts and/or low pivoting speeds of the apparatus 10. Advantageously, the output shaft 196 can be made of aluminum in order to achieve high reciprocating speeds of the output shaft 196 and can increase the pivoting speed of the apparatus 110. Thus, the speed of the tufting process can be increased resulting in higher production rates of tufted fabric.

In operation, for example, a lower portion of a needle, such as needle 42 of FIG. 1, is engaged with the yarn strand Y1 and passes through the fabric 52 toward the apparatus 110. The needle 42 causes a portion of the yarn strand Y1 to pass through the fabric 52, such that the yarn strand Y1 forms a loop underneath the fabric 52. While the needle is in this position, the apparatus 110 is pivoted such that the bill 134 and a portion of the edge 132 pass through the loop formed by the yarn strand Y1 in substantially the identical manner as the apparatus 10 of FIG. 1 and FIG. 1A. The edge 132 holds the loop of yarn Y1 underneath the fabric 52 while the needle 42 is moved away from the apparatus 110 and above the fabric 52. The bill 134 can ensure that the loop of yarn Y1 does not slide off the hook 114, especially when the loop is cut by the knife to form cut pile.

When the connector 122 moves the gate 116 towards the bill 134, the lower portion 187 of the connector gate end 150 is disposed in the recess 184, such that the back surface 185 contacts and pushes lower portion 187 and/or the notch portion 186 contacts and pushes the notch 148 in the direction towards the bill 134. Thus, the gate 116 is moved towards the bill 134. When the connector 122 moves the gate 116 towards the actuator block 128, the lower portion 187 contacts and pushes the back contact surface 185 and/or contacts and pushes the notch 148 and/or the notch portion 186 contacts and pushes the notch 148 in the direction towards the actuator block 128. Thus, the gate 116 is moved towards the actuator block 128.

While particular forms of the invention have been described, it will be apparent that various modifications can be made without departing from the spirit and scope of the invention. Accordingly, it is not intended that the invention be limited, except as by the appended claims.

What is claimed is:

1. A connector for connecting an output shaft of an actuator to a gate of a tufting machine, the connector comprising an actuator connector portion configured to be connected to an output shaft of an actuator, an extension portion extending forwardly from and at an angle with respect to the actuator connector portion along a direction transverse to the axial direction, and a slot portion connected to the extension portion and defining a gate connector slot extending from the extension portion and configured to engage the gate of the tufting machine, the gate connector slot including lateral walls extending along lateral sides of a portion of the gate connected to the gate connector slot.

2. The connector of claim 1, wherein the connector slot further comprises a recess between the lateral walls that accommodates a portion of the gate connected to the gate connector slot.

3. The connector of claim 1, wherein the lateral walls prevent rotation of the gate about the longitudinal axis of the gate and prevent substantial lateral movement of the gate relative to the connector.

4. The connector of claim 2, wherein the connector is substantially made of plastic.

5. The connector of claim 2, wherein a portion of the longitudinal axis of the gate is disposed between a portion of the lateral walls.

6. The connector of claim 1, wherein the gate connector slot has a width greater than the width of the gate by less than about 0.003 inches.

7. The connector of claim 1, wherein the gate connector slot has a width that is about 0.001 inches greater than the width of the gate.

8. The connector of claim 1, wherein the gate connector slot comprises a notch portion and a recess, the gate comprising a notch and a connector gate portion, the notch of the gate accommodates the notch portion and the connector gate portion is within the recess.

9. A hook mounting arrangement for a tufting machine comprising:

a hook block rigidly supporting at least first and second hooks and slidably supporting at least first and second gates adjacent to the respective first and second hooks;

an actuator block supporting at least first and second actuators disposed respectively in first and second vertically offset rows;

a first connector comprising a first actuator connector portion connected to an output shaft of the first actuator, a first extension portion extending upwardly from the first actuator connector portion and a first slot portion defining a first gate connector slot extending from the first extension portion toward the first gate and adapted to be engaged by the first gate to connect the first connector to the first gate; and a second connector comprising a second actuator connector portion connected to an output shaft of the second actuator, a second extension portion extending vertically downwardly from the second actuator connector portion and a second slot portion defining a second gate connector slot extending from the second extension portion toward the second gate and adapted to be engaged by the second gate to connect the second connection to the second gate;

the first and second actuators being configured to reciprocally drive the first and second connectors in an axial direction, wherein the first and second actuator connector portions are interleaved with each other, such that the first and second gate connector slots are disposed substantially side-by-side, and are respectively connected to the output shafts of the first and second actuators with sufficient rigidity to prevent rotation of the first and second connectors about a generally horizontal axis.

10. The hook mounting arrangement of claim 9, wherein the at least one of the connectors has a length in the range of about 0.075 inches to 1 inch.

11. The hook mounting arrangement of claim 10, wherein a portion of the first extension portion and a portion of the second extension portion are separated a distance less than the width the gate.

12. The hook mounting arrangement of claim 9, wherein the first and second gate connector slots comprise a pair of walls defining a slot, each of the slots configured to receive a tufting gate such that the pair of walls prevent substantial rotation of the gate about the longitudinal axis of the gate and prevent substantial lateral movement of the gate relative to the respective first and second gate connector slots.

13. The hook mounting arrangement of claim 12, wherein there is no additional guide contacting the first and second connectors for preventing both rotation of the gate about the longitudinal axis of the gate and substantial lateral movement of the gate relative to the connector.

14. A hook mounting arrangement for a tufting machine comprising:

a hook support rigidly supporting at least first and second hooks and slidably supporting at least first and second gates adjacent to the respective first and second hooks;

an actuator block supporting at least first and second actuators disposed respectively in first and second vertically offset rows;

a first connector comprising a first actuator connector portion connected to an output shaft of the first actuator, a first extension portion extending vertically upwardly from the first actuator connector portion and a first slot portion extending from the first extension portion, the first slot portion defining a first gate connector slot including a notch in which one end of the first gate is received and including lateral walls extending adjacent to two lateral sides of the first gate; and a second connector comprising a second actuator connector portion connected to an output shaft of the second actuator, a second extension portion extending vertically downwardly from the second actuator connector portion and a second slot portion extending from the second extension portion, the second slot portion defining a second gate connector slot including a notch within which one end of the second gate is received and including lateral walls extending adjacent to two lateral sides of the second gate;

the first and second actuators being configured to reciprocally drive the first and second connectors in an axial direction, wherein there is no additional guide contacting the first and second connectors for guiding the first and second connectors in the axial direction.

15. The hook mounting arrangement of claim 14, wherein the first and second actuator connector portions are respectively connected to the output shafts of the first and second actuators with sufficient rigidity to prevent rotation of the first and second connectors about a generally horizontal axis.

16. The hook mounting arrangement of claim 15, wherein at least one the connectors has a gate connector slot with a width greater than the width of the respective gate by less than about 0.002 inches and has a length in the direction of the axial direction in the range of about 0.075 inches to 1 inch.

17. A method of manufacturing a tufting machine comprising providing a fabric feed assembly for feeding a fabric appropriate for carpet in a feeding direction, mounting an array of needles for reciprocal motion along a needle direction which is transverse to the feeding direction, mounting a hook assembly for reciprocal motion in a hook direction which is transverse to the needle direction, aligning a plurality of hooks on the hook assembly with the needles, mounting a plurality of gates in alignment with the plurality of hooks for reciprocal motion relative to the hooks, mounting an array of actuators in series with the plurality of gates, connecting the actuators to the gates with a plurality of connectors, each of the connectors having an actuator connector portion mounted to an associated actuator, an extension portion extending from the associated actuator in a direction substantially transverse to the hook direction and terminating at a slot portion adjacent an end of one of the gates, the slot portion defining a slot within which the end of the gate is received and having a pair of lateral walls extending along lateral sides of the end of the gate.

* * * * *